US010759635B2

(12) United States Patent
Seutter et al.

(10) Patent No.: US 10,759,635 B2
(45) Date of Patent: Sep. 1, 2020

(54) SIDAS—SPREADER IMPACT DAMAGE AVOIDANCE SYSTEM

(71) Applicants: Abraham Ben Seutter, Chilliwack (CA); Aaron Seutter, Edmonton (CA)

(72) Inventors: Abraham Ben Seutter, Chilliwack (CA); Aaron Seutter, Edmonton (CA)

( * ) Notice: Subject to any disclaimer, the term of this patent is extended or adjusted under 35 U.S.C. 154(b) by 162 days.

(21) Appl. No.: 16/000,823

(22) Filed: Jun. 5, 2018

(65) Prior Publication Data

US 2019/0367336 A1 Dec. 5, 2019

(51) Int. Cl.

| | |
|---|---|
| ***B66C 13/44*** | (2006.01) |
| ***B66C 1/10*** | (2006.01) |
| ***B66C 13/08*** | (2006.01) |
| ***B66C 13/42*** | (2006.01) |

(52) U.S. Cl.

CPC ..... *B66C 13/44* (2013.01); *B66C 1/101* (2013.01); *B66C 13/085* (2013.01); *B66C 13/42* (2013.01); *B66C 2700/082* (2013.01)

(58) Field of Classification Search

CPC ..... B66C 13/44; B66C 13/42; B66C 13/085; B66C 1/101; B66C 2700/082

See application file for complete search history.

(56) References Cited

U.S. PATENT DOCUMENTS 4,449,882 A * 5/1984 Perrott ..... B66F 9/186 294/81.2

7,341,422 B1 * 3/2008 McCown ..... B63B 25/004 414/140.1

8,352,128 B2 1/2013 Stocker et al.

(Continued)

FOREIGN PATENT DOCUMENTS

| | | |
|---|---|---|
| CA | 2245597 | 12/2003 |
| CA | 2602984 | 6/2012 |

(Continued)

OTHER PUBLICATIONS

Hyster Reach Stacker Brochure, Dec. 3, 2016, https://web.archive.org/web/20161203004419/https://www.devliegerheftrucks.nl/designimages/vlieger/nieuwe_heftrucks/RS45-46.pdf (Year: 2016).*

(Continued)

*Primary Examiner* — Dale W Hilgendorf
*Assistant Examiner* — Alexander C. Bost
(74) *Attorney, Agent, or Firm* — Robert A. Nissen

(57) ABSTRACT

Embodiments of this document provides improved safety logic for a mobile container handler of the reach stacker or top pick type. The improved logic involves limitations surrounding the hoist function of the machine subsequent to attaching to a shipping container. This improvement addresses damage to the container spreader caused by abrupt joystick hoist inputs by the operator immediately subsequent to attaching onto a shipping container. Due to space between the spreader arms and spreader body, which is so designed to facilitate movement of the arms inside the spreader body, sudden vertical movement of the spreader results in impact forces being exerted on various parts of the spreader body and spreader arms. These impacts accelerate fatigue leading to premature catastrophic failure of the spreader body and/or spreader arms' structural steel.

22 Claims, 8 Drawing Sheets

(56) References Cited

U.S. PATENT DOCUMENTS 8,545,161 B2 * 10/2013 Wanek-Pusset ..... B66F 9/125 187/237
2005/0232741 A1 * 10/2005 Laenge ..... B66F 9/0655 414/718
2006/0180381 A1 * 8/2006 Sonderegger ..... B66F 9/0655 180/282
2007/0173999 A1 * 7/2007 Shinozaki ..... B66F 9/065 701/50
2008/0193246 A1 * 8/2008 Bohman ..... B60P 7/132 410/82
2008/0252417 A1 * 10/2008 Thomas ..... B66C 13/46 340/10.1
2009/0257853 A1 * 10/2009 Marston ..... B66C 1/101 414/425
2010/0192486 A1 * 8/2010 Khoon ..... B65G 63/004 52/173.1
2011/0006024 A1 1/2011 Schneider et al.
2011/0055172 A1 * 3/2011 Tan ..... G06Q 10/08 707/692
2011/0270488 A1 * 11/2011 King ..... B66C 13/48 701/31.4
2013/0032561 A1 2/2013 Singhose et al.
2014/0009612 A1 * 1/2014 King ..... B66F 9/0755 348/143
2014/0279292 A1 * 9/2014 Schmidt ..... B66C 13/46 705/28
2014/0312638 A1 * 10/2014 Ng ..... B66C 1/104 294/86.4
2015/0030422 A1 * 1/2015 Karlsson ..... B66C 1/101 414/620
2019/0077638 A1 * 3/2019 Karlsson ..... B66C 1/101
2020/0002137 A1 * 1/2020 Hetherington ..... B66C 1/14

FOREIGN PATENT DOCUMENTS

CA 2672056 3/2013
CA 2831901 9/2014
JP 2012206825 7/2015
JP 2012206823 3/2016

OTHER PUBLICATIONS

Reggiane Cranes and Plants S.p.A, "Terex Operator Manual", 2010, two parts, 101 and 114 pages, respectively, Terex.
Hyster, "Laden Container Handling Trucks H40.00-50.00XM-16CH", 2006, 12 pages, Hyster, England.
Konecranes, "Container Lift Trucks", 2013, 24 pages, Konecranes, Sweden.
Linde, "Engine-Powered Laden Container Handler 36000kg and 40000kg", 2003, 4 pages, Linde, Germany.

* cited by examiner

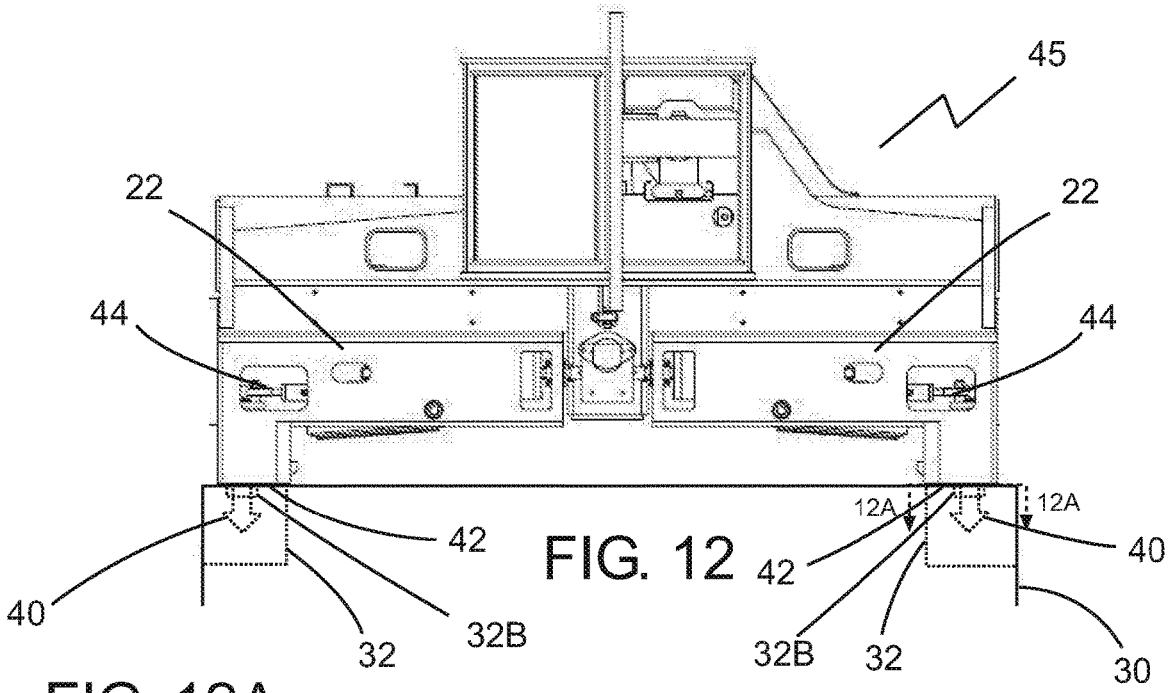
FIG. 12
FIG. 12A
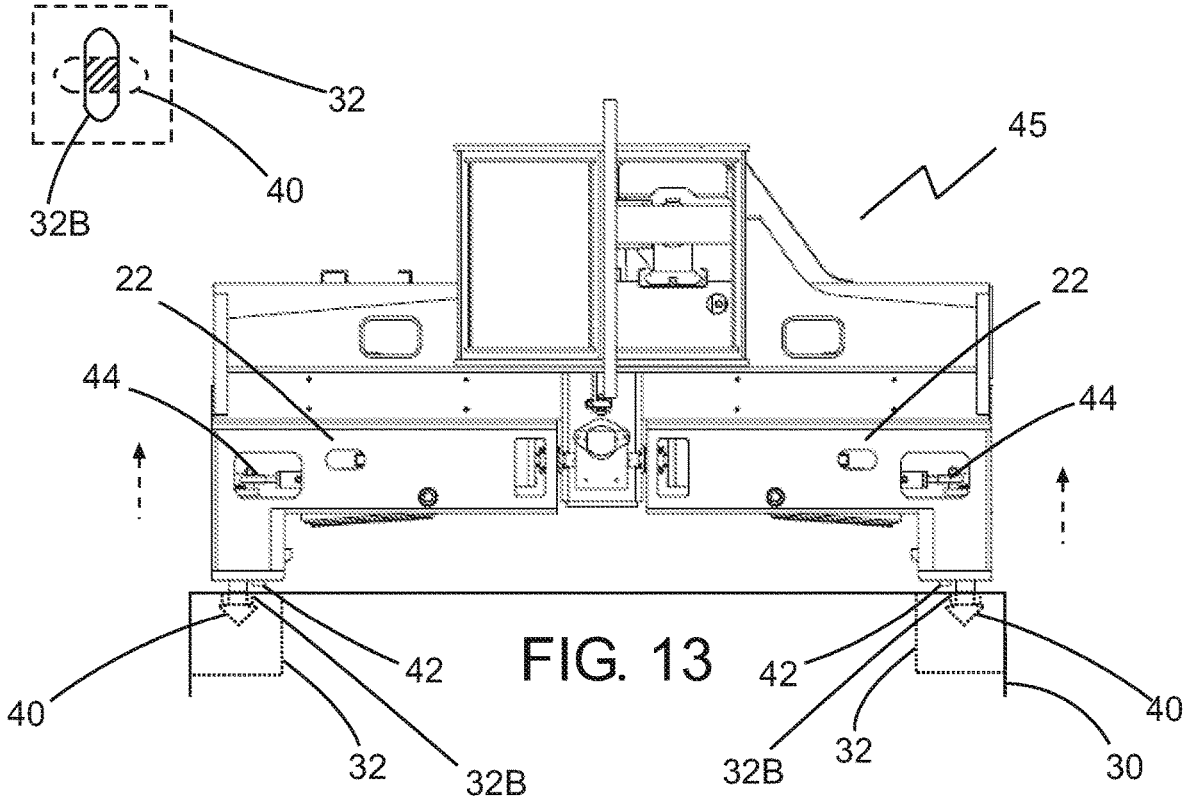
FIG. 13

FIG. 14
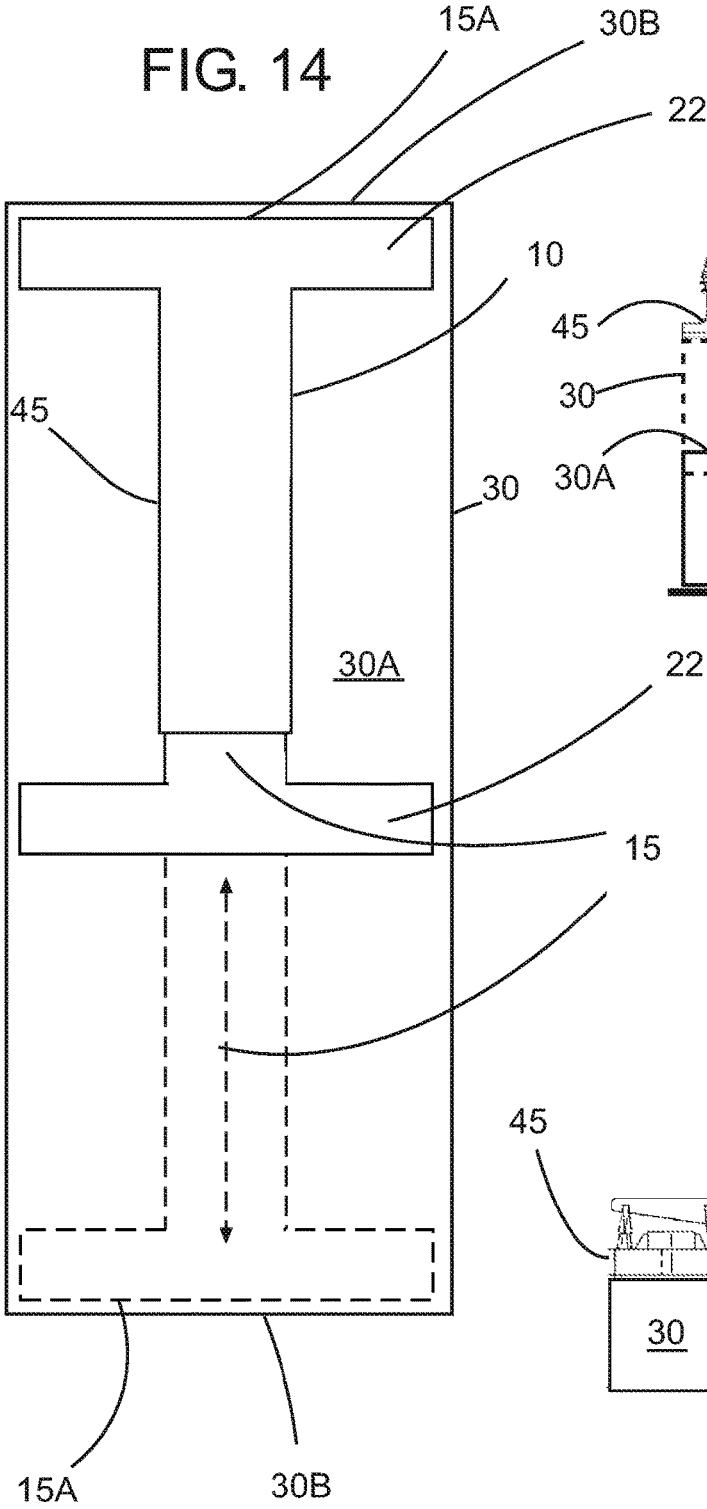
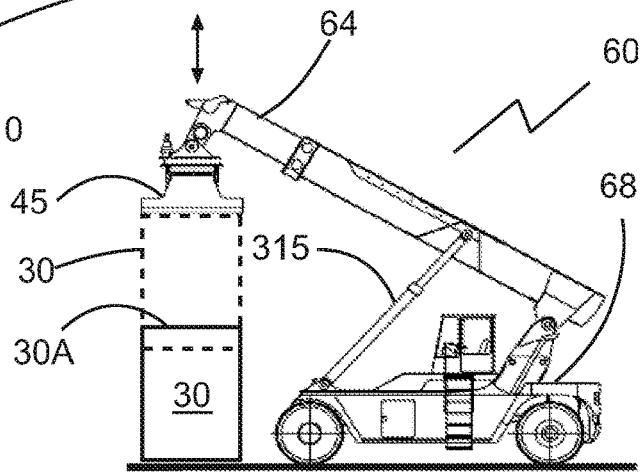
FIG. 15
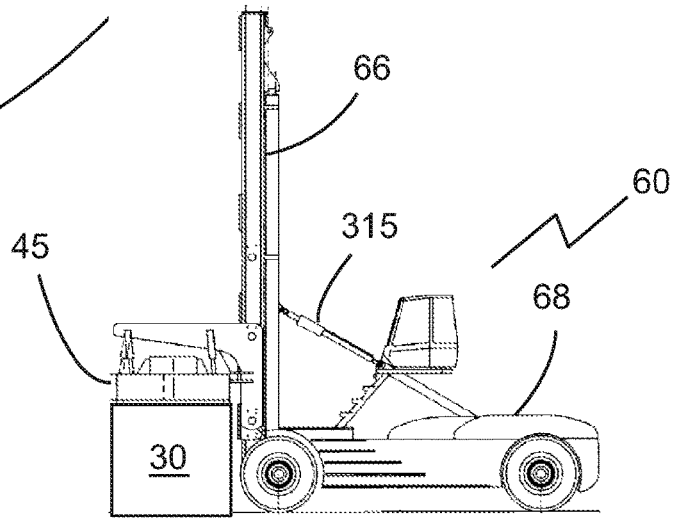
FIG. 16

SIDAS—SPREADER IMPACT DAMAGE AVOIDANCE SYSTEM

TECHNICAL FIELD

This document describes an improvement on the boom/mast safety control system of mobile shipping container handlers. A mobile shipping container handler comprises a chassis that is connected to a container spreader via a boom or mast, with such handlers more commonly referred to as reach stacker or top pick container handlers.

BACKGROUND

Mobile shipping container handlers are used worldwide and are manufactured by numerous companies. They are commonly found at rail intermodal yards or container shipping ports. Operation of a container handler is performed by a person referred to as the operator. The operator uses various controls including a joystick to maneuver the spreader. Over the years, safeties have been built into the machine using electric relays and timers and/or computer systems, such as a PLC (Programmable Logic Control), to decrease the number of accidents caused by operator error. The safety logic surrounding hoist function is typically limited based on the following situations:

1) Is the machine locked onto a container? (Green light)
2) Is the machine unlocked from a container? (Red light)
3) Is the machine within its safety envelope?

The locked and unlocked information is determined by proximity sensors on the twistlocks that are located in the four corners of the spreader (some older machines use only two sensors, one for each arm). The machine safety envelope is determined based on the type of machine. On a typical top pick, the safety envelope is simply the maximum capacity of the machine and weight is measured with a load cell or a pressure sensor on one or both of the lift cylinders. On a reach stacker, the safety envelope is more complex due to significant changes in the center of gravity caused by the reach capability of the machine. The envelope is determined based on three sensor readings. These readings are:

a) Boom angle—Inclinometer sensor
b) Boom length—Cable reel with a potentiometer
c) Weight of the load—Load cells or pressure sensors on the lift cylinders A calculation of the boom angle and length readings is performed repeatedly and the maximum lift capacity is adjusted based on that calculation. The weight of the load is then logically compared to the maximum lift capacity to ensure that the machine is still within its safety envelope. If any one of the aforementioned situations are not met, boom/mast function is limited. In the event of situation 1 or 2 failing to be met, all boom/mast hoist and lower functions are locked. In the event of situation 3 failure, boom/mast hoist is locked.

SUMMARY

One area of limitation that has been overlooked is in the regulating of hoist function immediately after attaching the spreader to a shipping container. The machine manufacturers expect the operator to operate the controls smoothly and slowly when initially hoisting a load. However, the increased demand for faster operation and higher container lifts per hour has resulted in many operators ignoring this expectation. This results in significant strain and impact forces on the spreader that were not intended. Embodiments of this document may resolve this discrepancy between manufacturer expectations and operator's actions. Through the use of existing sensors, additional programming logic may be added to the machine to limit the hoist functionality of the machine subsequent to attaching onto a shipping container.

A method is disclosed of operating a mobile container handler, which has a spreader mounted on an extendable boom or a mast and carriage assembly, the method comprising: a. monitoring whether the spreader is locked to the shipping container; b. monitoring whether the spreader is landed on the shipping container; c. limiting a hoist function of the mobile container handler when both of the following conditions are satisfied: i=the spreader is locked to the shipping container; and ii=the spreader is landed on the shipping container; and d. resuming a normal mode of the hoist function of the mobile container handler when all of the following conditions are satisfied: iii=the spreader is locked to the shipping container; and iv=the spreader is not landed on the shipping container.

A method is disclosed for use with a mobile container handler of the reach stacker or top pick type in which the limitation of hoist function immediately subsequent to attaching the container spreader to a shipping container is achieved by the following logic: a. Monitoring the locked or unlocked signals from the spreader twistlock position sensors, b. Monitoring the landed signal from the spreader seated pin position sensors, c. Limiting hoist function if the results from a & b are: i. a=spreader attached to a shipping container, ii. b=spreader landed on a shipping container, d. Resume normal hoist function once the result from b becomes negative and the elapse of a prescribed amount of time (presumably 2 seconds but adjustable based on machine).

In various embodiments, there may be included any one or more of the following features: The mobile container handler comprises a chassis with a drive axle and a steer axle, and that is connected to the spreader by an extendable boom. The mobile container handler comprises a chassis with a drive axle and a steer axle, and that is connected to the spreader by a mast and carriage assembly. The method is performed using control signals from a controller. The controller comprises a PLC (Programmable logic control). The controller controls the hydraulic hoist directly by means of a PWM (Pulse Width Modulation) value. The hydraulic hoist is controlled indirectly by means of a pilot control valve. The pilot control valve is located inline on a hoist pilot pressure from a joystick that controls a hoist valve. The pilot control valve comprises a pressure control valve. The pilot control valve comprises a flow control valve. The pilot control valve comprises a directional control valve and a pressure relief valve. Performing the method using electric relays and timers. Resuming further comprises resuming the normal mode of the hoist function of the mobile container handler when all of iii, iv, and the following condition are satisfied: v=a prescribed non-zero amount of time has elapsed after condition iv has occurred. The prescribed non-zero amount of time comprises two or more seconds. The spreader comprises twistlocks for locking the shipping container. Monitoring whether the spreader is locked is performed using signals from position sensors on the twistlocks. Monitoring whether the spreader is landed is performed using signals from landed pin position sensors on the spreader. Limiting the hoist function comprises reducing the maximum power of the hoist function to 25% or less relative to the maximum power of the hoist function when in the normal mode. Retrofitting the mobile container handler with a controller programmed to carry out the method. The mobile container handler comprises a reach stacker or a top pick. A mobile container handler configured to perform the method. A controller programmed to carry out the method when installed on the mobile container handler. A reach stacker in which the machine comprises a chassis with a drive axle and a steer axle that is connected to the container spreader by an extendable boom. A top pick in which the machine comprises a chassis with a drive axle and a steer axle that is connected to the container spreader by a mast and carriage assembly. The logic is performed by a PLC (Programmable logic control) or similar computer system designed for use on mobile industrial equipment. The PLC or computer system controls the hydraulic hoist directly by means of a PWM (Pulse Width Modulation) value. The PLC or computer system controls the hydraulic hoist directly by means of a PWM (Pulse Width Modulation) value. The PLC or computer system controls the hydraulic hoist indirectly by means of a pilot control valve, comprises a pressure control valve, located inline on the hoist pilot pressure from the joystick that controls the hoist valve. The logic is performed using electric relays and timers. The electric relays and timers controlling the hydraulic hoist indirectly by means of a pilot control valve, comprising a pressure control valve, located inline on the hoist pilot pressure from the joystick that controls the hoist valve. The electric relays and timers controlling the hydraulic hoist indirectly by means of a pilot control valve, comprising a pressure control valve, located inline on the hoist pilot pressure from the joystick that controls the hoist valve. The pilot control valve comprises a flow control valve. The pilot control valve comprises a directional control valve and a pressure relief valve.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

a. a pressure control valve, b. a flow control valve or, c. a directional control valve and a pressure relief valve.

Figure 5:
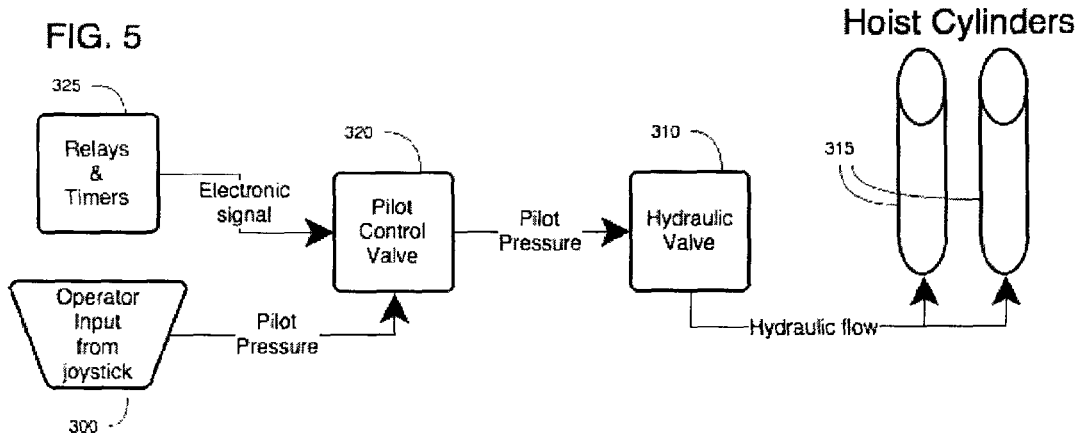

FIG. 5 is a block diagram illustration of a relay timer system that controls the hoist function indirectly through a pilot control valve, comprising one of the following:

a. a pressure control valve, b. a flow control valve or, c. a directional control valve and a pressure relief valve.

FIGS. 6-9 are a series of end elevation views illustrating a method of using a spreader of a mobile container handler to land, lock, and lift a shipping container, using hooking pins to lock to the sides of the container.

FIGS. 10-13 are a series of end elevation views illustrating another method of using a mobile container handler to land, lock, and lift a shipping container, using twistlocks to lock to the top of the container. FIG. 12A is a section view taken along the 12A-12A section lines of FIG. 12.

FIG. 14 is a top plan view illustrating a spreading action of the spreader to fit a shipping container, with the outline of the spreader in retracted and extended modes illustrated in solid and dashed lines, respectively.

FIG. 15 is side elevation view illustrating a reach stacker mobile container handler and a shipping container, with the shipping container in two positions, namely a) disposed on a ground surface (solid lines) and b) lifted above the ground and locked to the spreader (dashed lines).

FIG. 16 is side elevation view illustrating a top pick mobile container handler and a shipping container, with the shipping container positioned on the ground.

DETAILED DESCRIPTION

Immaterial modifications may be made to the embodiments described here without departing from what is covered by the specification.

Embodiments of this document are advantageously designed to address damage caused by abrupt operator inputs on the joystick of a reach stacker or top pick container handler when initially hoisting a shipping container.

Based on conventional logic, there is no limitation in the hoist provided the aforementioned situations are met. A lack of limitation to boom/mast hoist is the cause of significant spreader damage. The situation in question occurs immediately after the spreader is attached to a container. The machine is within its safety parameters and full hoist function is allowed. The operator can pull full power on hoist resulting in a sudden upward jolt on the spreader. This is a problem due to space between the spreader arms 15 and the spreader body 10. The space exists to facilitate movement of the spreader arms inside the spreader body. Some of this space is removed with the wear pads 20, but as the pads wear, the space increases. The sudden hoisting of the spreader causes impact points on various parts of the spreader body and/or the spreader arms based on the orientation of the spreader. On most models, the spreader body comprises two square tubes joined together with additional reinforcing steel, although other variations of spreaders may be used. The spreader arms can be in one of several orientations, including:

1) Oriented for 20' containers,

2) Oriented for 40'+containers.

Referring to FIGS. 1A-D, the impact location may change depending on the orientation of the spreader arms 15. In the 20' orientation, impact may occur on the bottom side (position 25) of the spreader body 10 where the spreader arms 15 are inserted into the spreader body 10. In the 40' orientation, impact may occur at the same location (position 25) as the 20' orientation and on the top of the spreader body (position 35) on the inside where the arms meet the spreader body 10. This last location of impact (position 35) is often severe, resulting in the spreader body 10 fatiguing and severe structural failure of the plate steel on the top center (position 35) of the spreader body 10. The prior mentioned damage in this example has been occurring for decades with total cost of damage being unknown but presumably in the hundreds of millions of dollars.

Figure 1A:
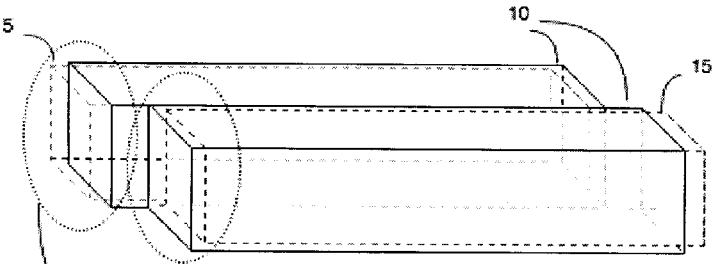
FIG. 1A is a simplified 3-dimensional view of the spreader arms 15 inserted into the spreader body 10. The spreader comprises two identical arms oriented 180 degrees to each other with a corresponding tube on the spreader body.
Figure 1B:
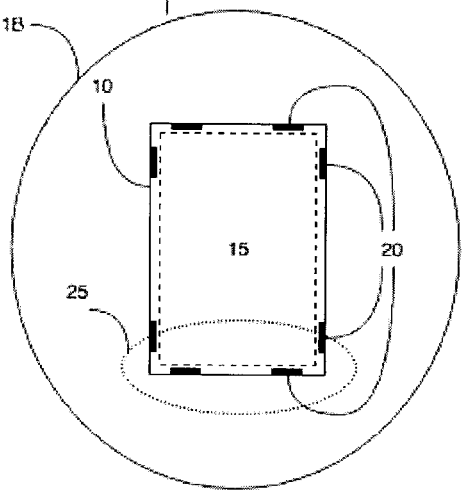
FIG. 1B is a flattened end view of the apparatus of FIG. 1A with one of the spreader arms 15 inside the spreader body 10. This is the left side of the spreader where the left arm extends from. The wear pads 20 are attached to the spreader body and spaces exist to facilitate movement of the arm while attempting to limit slack.
Figure 1C:
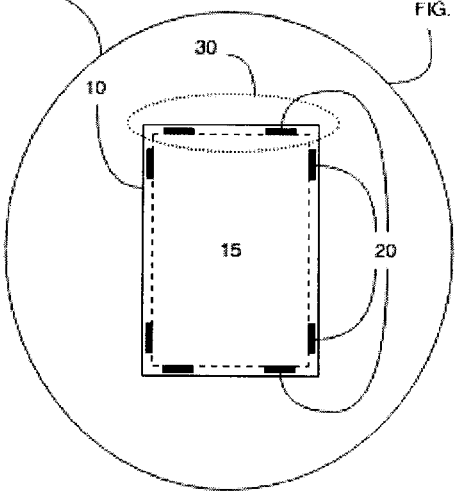
FIG. 1C is a flattened end view of the apparatus of FIG. 1A with one of the spreader arms 15 inside the spreader body 10. This is the left side of the spreader where the end of the right arm is visible when in the 20' orientation. The wear pads 20 are attached to the end of the spreader arm and spaces exist to facilitate movement of the arm while attempting to limit slack.
Figure 1D:
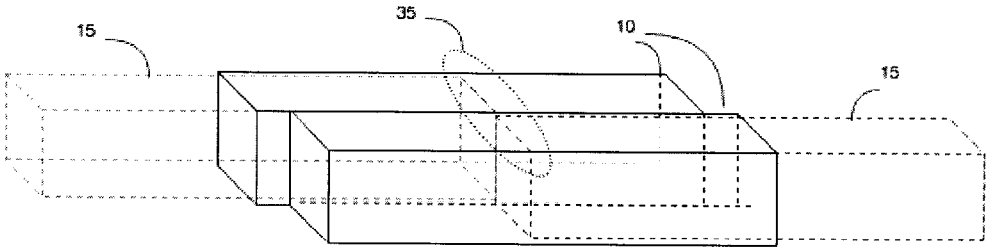
FIG. 1D is a simplified 3-dimensional view of the spreader arms 15 extended to the 40' orientation.
Figure 2:
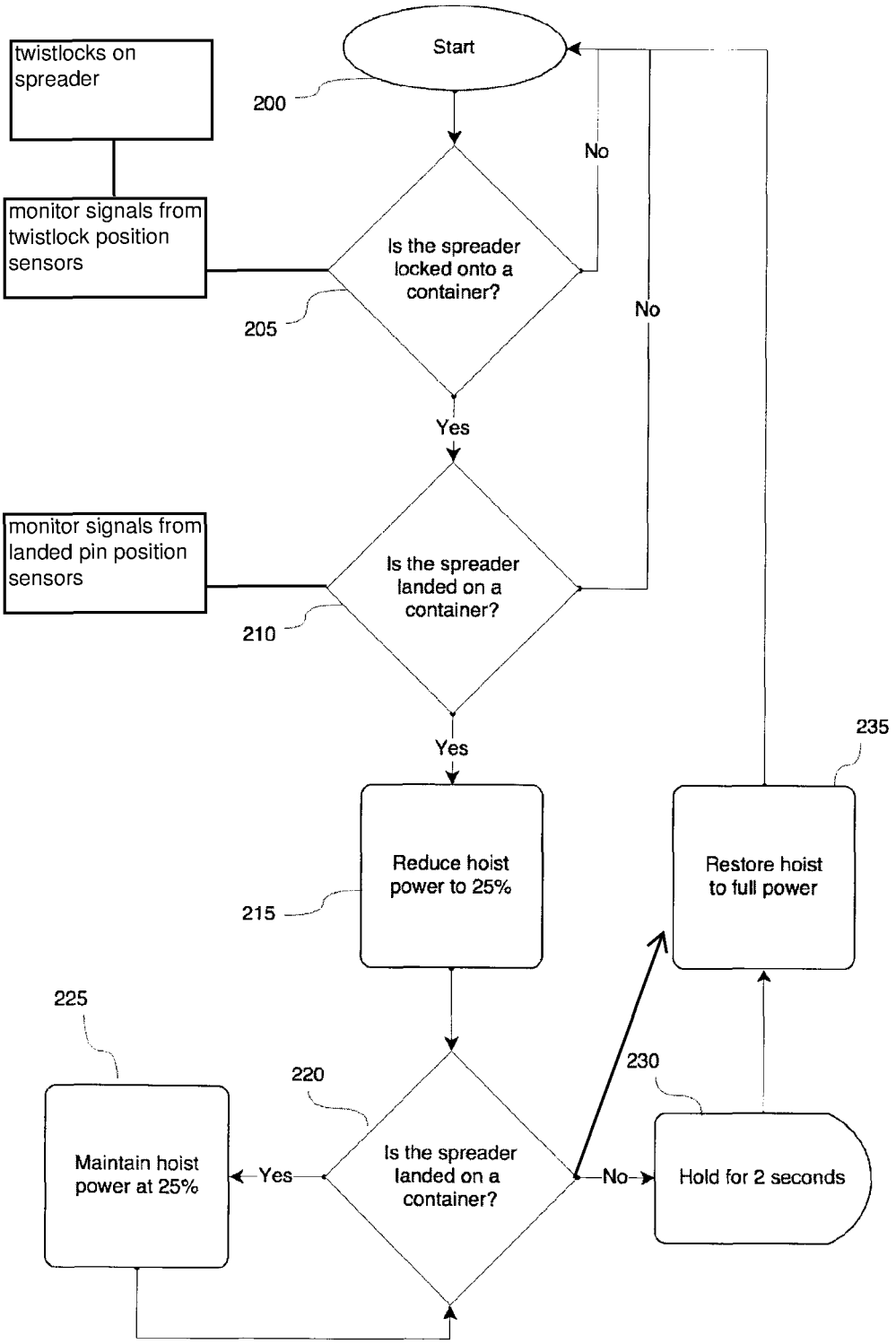
FIG. 2 is a block diagram illustration of the methodology logic of an embodiment process.

Referring to FIG. 2, a method of operating a mobile container handler 60 is illustrated. Referring to FIGS. 15-16, the handler 60 may comprise a spreader 45. Spreader 45 may be mounted on an extendable boom 64 (FIG. 15) or a mast and carriage assembly 66 (FIG. 16). The handler 60 may comprise a chassis 68 with a drive axle and a steer axle. The embodiments shown may also be commonly referred to as reach stacker (FIG. 15) or top pick (FIG. 16) style mobile container handlers 60. In some cases a container handler 60 may be retro fitted with a suitable controller or other suitable control device programmed to carry out the method.

Figure 10:
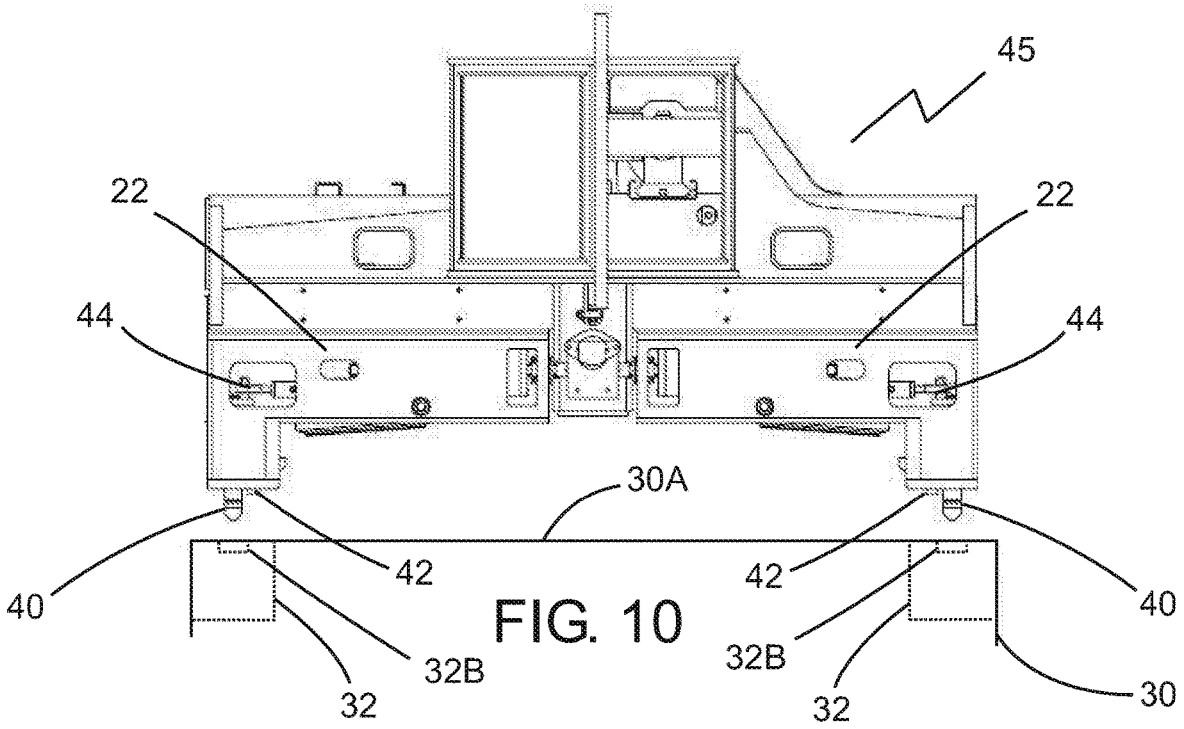

Embodiments of this document may eliminate the damage being caused by sudden hoist inputs by the operator subsequent to attaching to a shipping container. This may be achieved by adding additional logic to the safety system of the machine. Referring to FIG. 2 the following logical steps may be used, for example added to the controller:

1) Is the spreader locked onto a shipping container (stage 205)? (A suitable indicator may be displayed to the operator, for example a green light)
   i. Referring to FIG. 10, the method may involve monitoring to see whether the spreader 45 is locked. Monitoring whether the spreader 45 is locked may be performed using signals from a suitable sensor, for example proximity or other position sensors 44 for twistlocks 40, with locked information obtained from the locked or unlocked twistlock position sensors 44.
2) Referring to FIG. 2, if yes to 1), is the spreader landed on a shipping container (stage 210)? (A suitable indicator may be displayed to the operator, for example a yellow light)
   ii. Referring to FIG. 10, the method may involve monitoring to see whether the spreader is landed on the shipping container 30. For example, the spreader may comprise of landed pin sensors 42 or other suitable sensors, and monitoring for unlanding may be performed by using signals from the landed pin position sensors 42.
3) Referring to FIG. 2, if yes to 1) and 2), perform the following:
   a. Limit hoist function by reducing maximum hoist power (stage 215) to a prescribed amount (25% of maximum power but could be adjusted based on machine), while the spreader is locked to the shipping container, and the spreader is not landed on the shipping container.
   b. Monitor landed signal (stage 220) and upon loss of signal, resume a normal mode of the hoist function (stage 235), or maintain reduced hoist power (stage 225) for an additional prescribed amount of time (stage 230), in this example 2 seconds is used, after which the controller may move to resume a normal mode of the hoist function, or restore hoist to full power (stage 235). (A suitable amount of time may be selected, and may be different based on machine, for example 1 second, 5 seconds, or more or less), and in some cases the time period may be adjustable by the operator or controller.
   c. Return to start (stage 200)

In previously mentioned embodiments, with the addition of the previously described logic, the operator will no longer be able to pull at full power on hoist and cause impact forces on the spreader 45 immediately after attaching to a shipping container 30. This may in turn eliminate or reduce the damage cause by impact forces that were previously commonplace.

Figure 3:
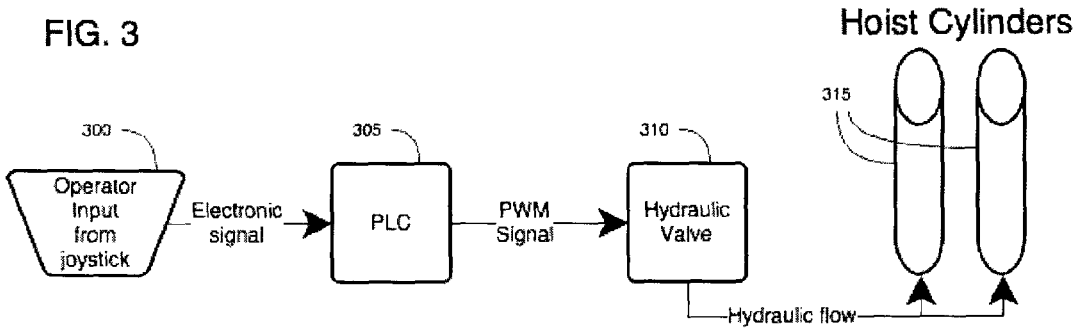
FIG. 3 is a block diagram illustration of a PLC (programmable logic control) system that controls the hoist function directly using a PWM (Pulse Width Modulation) valve.
Figure 4:
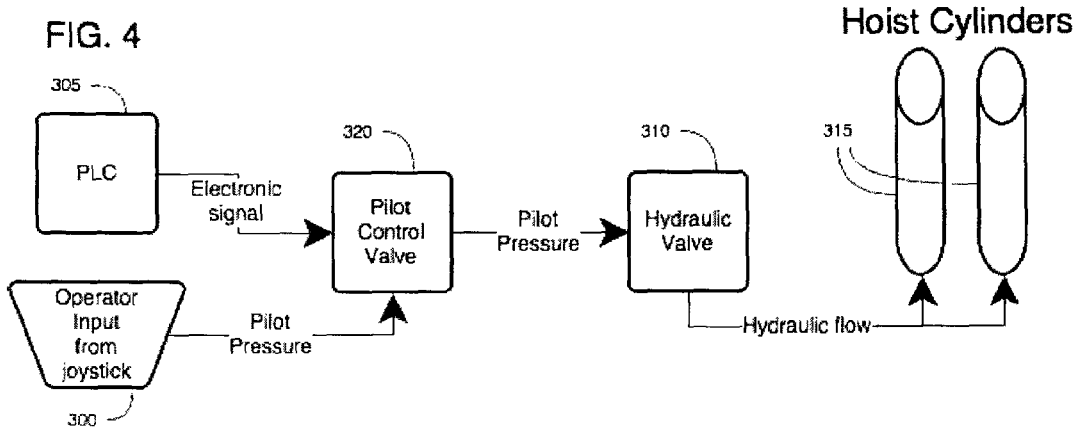
FIG. 4 is a block diagram illustration of a PLC system that controls the hoist function indirectly through a pilot control valve, comprising one of the following.

Referring to FIGS. 3-5, various embodiments are described of how to administer logic controls on hoist function. One embodiment achieves the desired function through the use of a Programmable Logic Control (PLC 305) or similar computer system designed for mobile container handlers 60. Some embodiments achieve same through the use of electric relays and timers 325.

Referring to FIG. 3, a method is described using a PLC 305 system to administer control logic on hoist function. For example, operator input from the joystick 300 may be converted to an electronic signal that is transmitted to the PLC 305. The PLC 305 may thereafter output a PWM (Pulse Width Modulation) signal to a hoist valve, for example hydraulic valve 310, which may be, for example, a PWM directional control valve. Hydraulic valve 310 delivers hydraulic fluid to the hoist cylinders 315 corresponding to the hydraulic flow indicated by the PMW signal.

Referring to FIG. 4, a method is described for using a pilot control valve 320 for administering logic controls on hoist function. A pilot control valve 320, for example, may be located inline on a hoist and may include the following:

a. a pressure control valve, b. a flow control valve and/or, c. a directional control valve and a pressure relief valve.

In the example shown, operator input on the joystick 300 may be transmitted to a pilot control valve 320 via hydraulic pilot pressure. PLC 305 may transmit an electronic signal to the pilot control valve 320 if hoist function is permitted. Pilot control valve 320 may receive a signal from PLC 305 indicating that hoisting is permissible and thus valve 320 may allow pilot pressure from the input on the joystick 300 through the pilot control valve 320 to a hydraulic valve 310. Hydraulic valve 310 may be a suitable valve, such as a directional control valve that delivers hydraulic fluid to the hoist cylinders 315.

Referring to FIG. 5, a method is described where electric relays and/or timers 325 may be used to administer logic controls on hoist function. In the example shown, relays and timers 325 may transmit an electronic signal to a pilot control valve 320 indicating that hoisting is permitted. Operator input on the joystick 300 is transmitted via pilot hydraulic pressure to a pilot control valve 320. Pilot control valve 320 may receive a signal from the relays and timers 325 indicating that hoisting is permissible and valve 320 may thus allow pilot pressure from the inputs on the joystick 300 through the pilot control valve 320 to a hydraulic valve 310. If hoisting is permissible, the pilot pressure is permitted through the pilot control valve 320 to a hydraulic valve 310, Referring to FIGS. 6-9 and 14-16, an embodiment is illustrated of locking and lifting a shipping container using hooking pins 26 on the interior sides of fingers 22 of a spreader 45 for a mobile container handler 60. Referring to FIG. 14-16, the spreader 45 is first positioned above a top face 30A of the container 30. Referring to FIG. 14, once in place adjacent the top face 30A, the spreader arms 15 are extended or retracted as needed relative to the spreader body 10 in order to align the distal ends 15A of each arm 15 into respective positions adjacent respective opposed ends 30B of the container 30, or to other suitable locations for locking the spreader 45 to the container 30.

Figure 6:
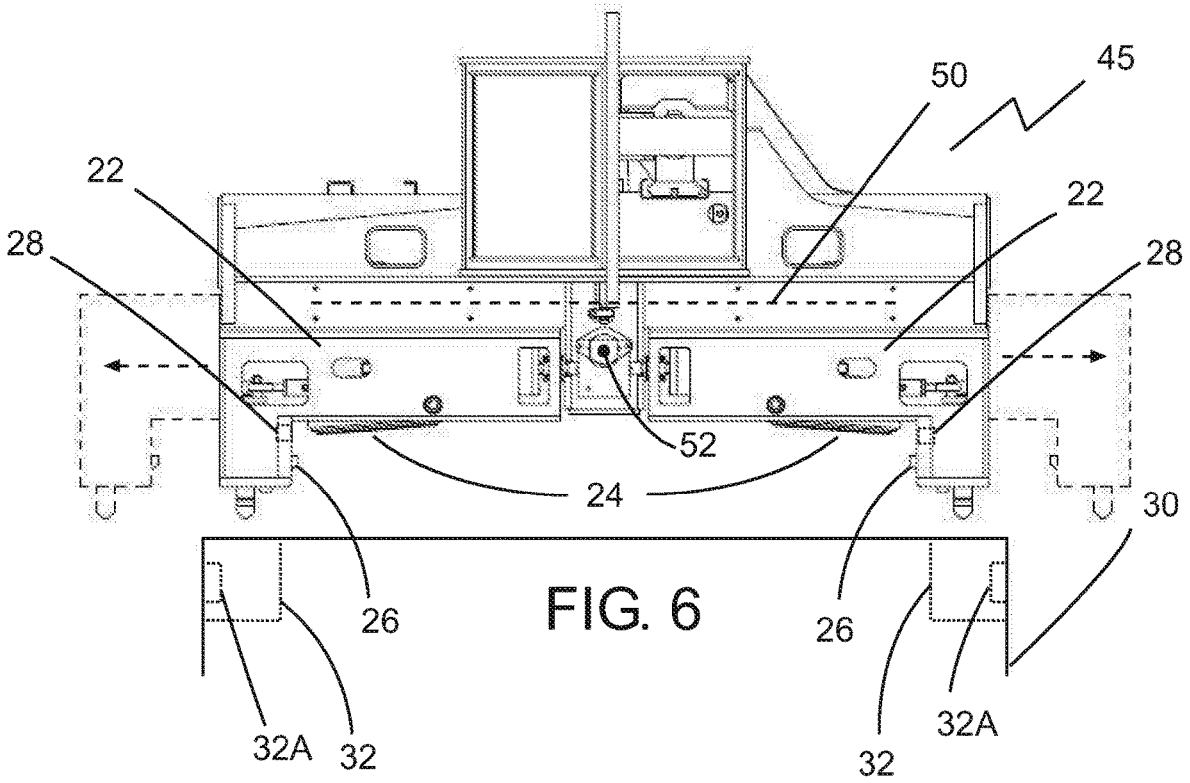

Referring to FIG. 6, each arm 15 may have parts, such as opposed fingers 22, that are mounted to spread relative to one another, for example along an axis 50 transverse to an axis 52 of spreading action of the spreader 45, in order to engage side walls 30C of the container 30. The fingers 22 may be extended or retracted as needed in order to extend fingers 22 into respective positions (shown in dashed lines in the figure) beyond the side walls 30C of the container 30.

Figure 7:
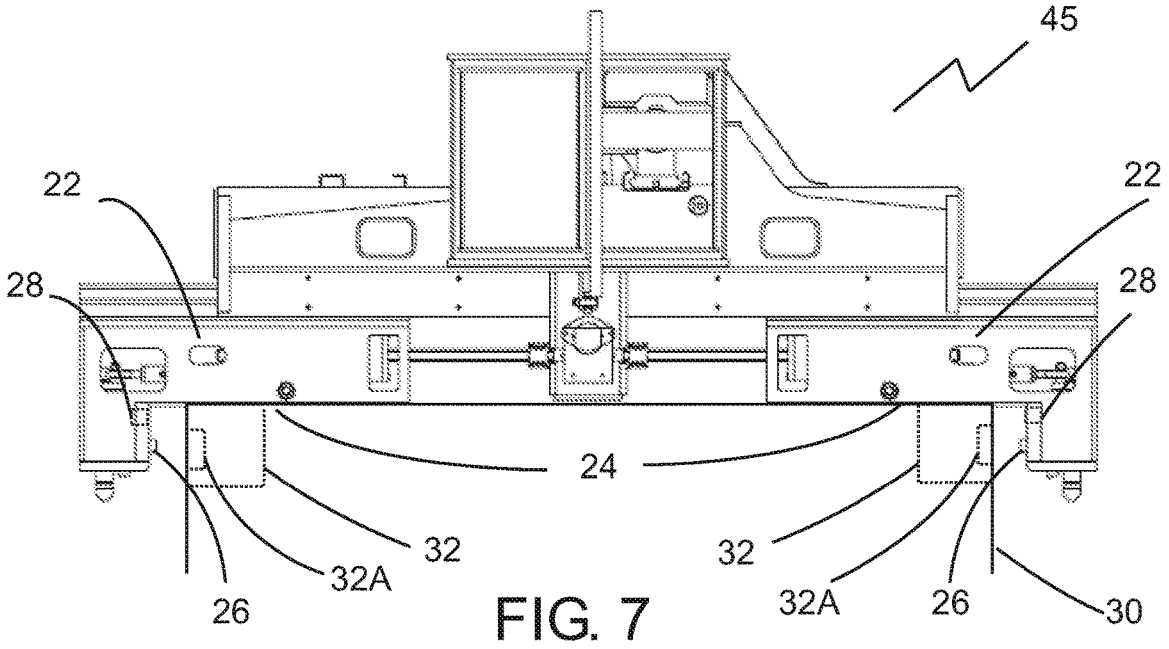
Figure 8:
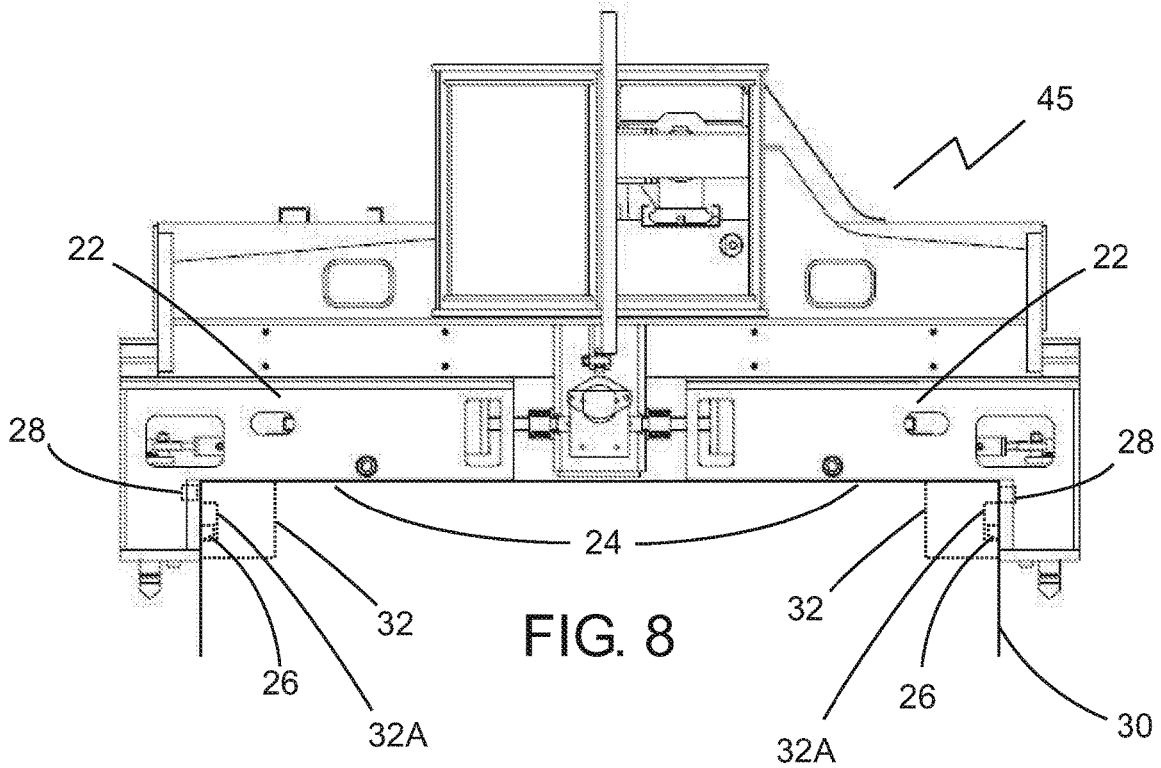

Referring to FIG. 7, once the fingers 22 are in a suitable position, the spreader 45, may be lowered into contact with (landed upon) the shipping container 30. In the example shown, the spreader 45 is lowered onto the container 30 such that the position sensor pads 24 (FIG. 6) engage the container 30 and send signals to the controller to alert the container handler 60 to stop lowering to prevent damage. The spreader 45 is now in the landed position. Referring to FIGS. 7-8, the fingers 22 may be converged sufficiently to engage the container 30, for example by insertion of respective hooking pins 26 of fingers 22 into respective hooking pin receptacles 32A defined in corner castings 32 of container 30. The hooking pin sensors 28, which may be suitable sensors such as proximity sensors, are used to detect the locked position shown in FIG. 9, indicating that the pins 26 are safely engaged and the container handler 60 can begin to lift.

Figure 9:
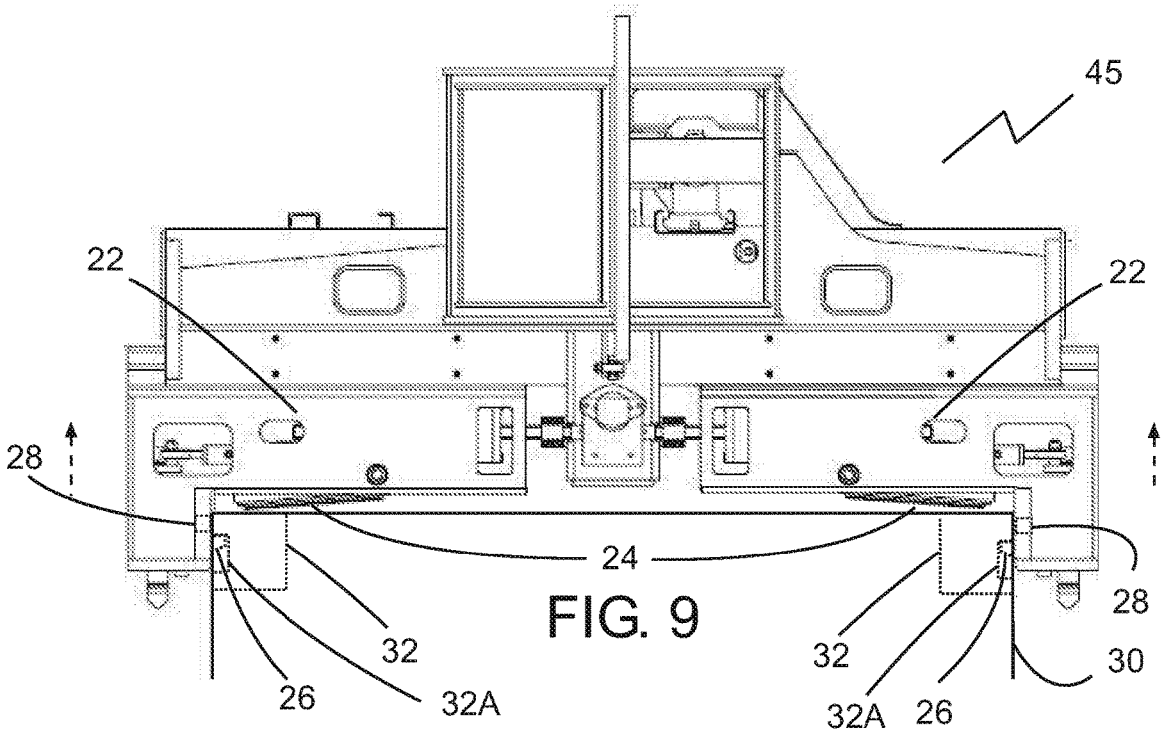

Referring to FIG. 15-16, the control logic incorporated in the container handler 60 may permit the container handler to begin to lift the spreader 45 and attached container 30, albeit using a limited hoist function, for example set at 25% of maximum power relative to the normal mode of operation of the hoist. The hoist function may be provided by operating one or more actuators, such as hoist cylinders 315 and extendable boom 64 (FIG. 15), or mast and carriage assembly 66 (FIG. 16), to raise and lower the container 30. In some cases adjusting parameters to balance the collective center of gravity of the handler 60 and container 30 to avoid tipping. Referring to FIG. 9, once the spreader 45 and container 30 have been lifted a sufficient distance, the pads 24 unseat and the spreader 45 and container 30 enter the unlanded, locked mode shown. Referring to FIGS. 15-16, once the unlanded, locked mode is detected, and in some cases after the passage of a suitable amount of time, the control logic then enters a normal mode of the hoist function, permitting the hoist function of the container handler 60 to resume operating at up to maximum power.

Figure 11:
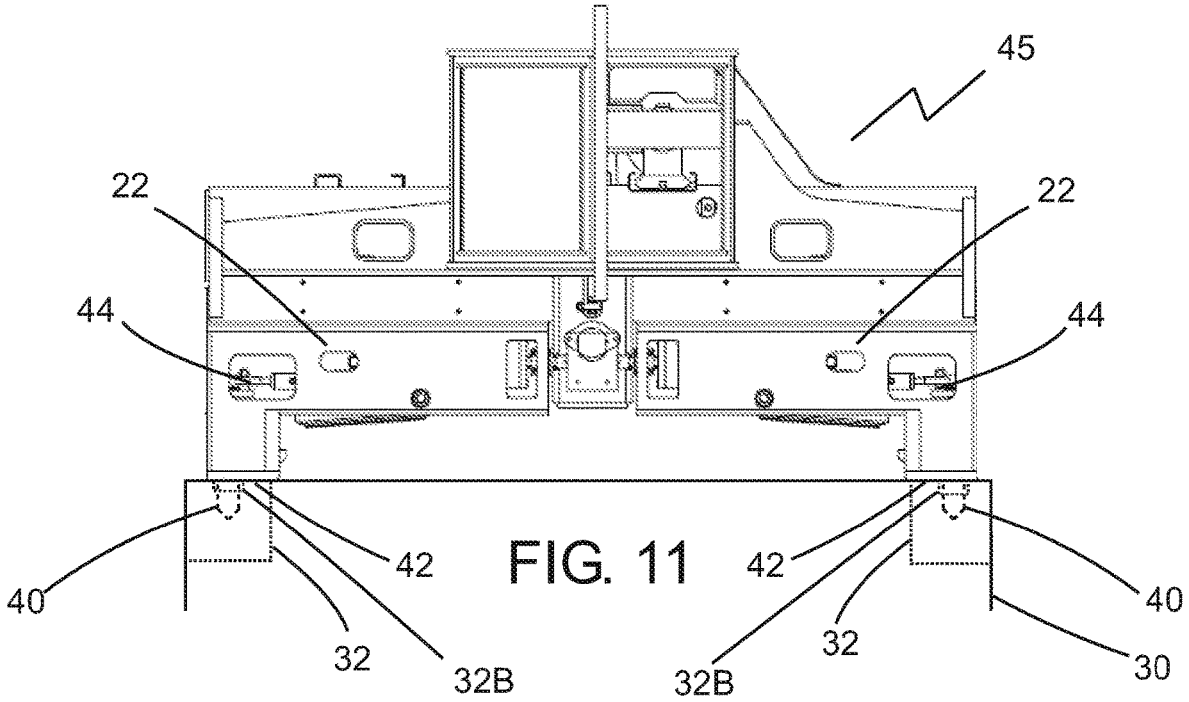

Referring to FIGS. 10-13 an embodiment is illustrated of locking and lifting a shipping container using twistlocks 40. Twistlocks 40 may be configured to engage the container 30 in a suitable fashion. The twistlocks 40 in FIGS. 10-13 are shown depending from fingers 22 of spreader arms 15, but may be in other suitable configurations. Referring to FIGS. 10-11, fingers 22 may mount twistlocks 40 that engage top face 30A of the container 30 for the purpose of locking and lifting. The spreader body 10 may be positioned so that the twistlocks 40 are aligned with respective receptacles 32B, which may be defined on the top faces, of the corner castings 32 of the container 30. In the example shown, spreader 45 is lowered into contact with (landed on) the shipping container 30 such that the twistlocks 40 enter the corresponding twistlock receptacles 32B on the top face of the corner castings 32. As twistlocks 40 enter receptacles 32B, landed pin position sensors 42 engage the container 30, and the controller may, upon receipt of signals from the landed pin sensors 42 indicating sufficient extension of twistlocks 40 into receptacles 32B, instruct the appropriate mechanism on container handler 60 to stop lowering to prevent damage. The spreader 45 is now in the landed position.

Referring to FIGS. 11-12 and 12A, the twistlocks 40 may enter the locked position, for example by rotating a sufficient amount such as ninety degrees into the position shown in FIGS. 12 and 12A in dashed lines. Referring to FIG. 12, the twistlocks 40 are engaged and in the landed locked position. Referring to FIGS. 15-16, from the locked and landed position, the control logic incorporated in the container handler 60, for example in a suitable controller, may then permit the operator to initiate the container handler 60 to begin to lift the spreader 45 and attached container 30, albeit using a limited hoist function, for example, set at 25% of the maximum power relative to the normal mode of operation.

The hoist function may be provided by operating one or more actuators, such as hoist cylinder 315 and extendable boom 64 (FIG. 15), or mast and carriage assembly 66 (FIG. 16), to raise and lower the container 30, adjusting parameters to balance the collective center of gravity of the handler 60 and container 30 to avoid tipping. Referring to FIG. 13, once the container has been lifted a sufficient distance, the landed pin sensors 42 unseat at least partially, upon which the spreader 45 and container 30 may enter the unlanded locked mode shown. Referring to FIGS. 15-16, once the unlanded lock configuration or mode is detected, the control logic enters a normal mode of the hoist function, permitting the container handler 60 to resume operating at up to maximum power. In some cases the control logic incorporates a further condition precedent to permitting maximum power, namely the elapse of a suitable prescribed non-zero amount of time has elapsed after the spreader 45 and container 30 enter the unlanded locked position. Signal flow may be through the controller or through direct connections between parts.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of operating a mobile container handler, which has a spreader mounted on an extendable boom or a mast and carriage assembly, the method comprising:

a. monitoring whether the spreader is locked to a shipping container;

b. monitoring whether the spreader is landed on the shipping container;

c. limiting a hoist function of the mobile container handler when both of the following conditions are satisfied:
i=the spreader is locked to the shipping container; and
ii=the spreader is landed on the shipping container; and d. resuming a normal mode of the hoist function of the mobile container handler when all of the following conditions are satisfied:
iii=the spreader is locked to the shipping container; and
iv=the spreader is not landed on the shipping container.

2. The method of claim 1 in which the mobile container handler comprises a chassis with a drive axle and a steer axle, and that is connected to the spreader by an extendable boom.

3. The method of claim 1 in which the mobile container handler comprises a chassis with a drive axle and a steer axle, and that is connected to the spreader by a mast and carriage assembly.

4. The method according to claim 1 in which the method is performed using control signals from a controller.

5. The method of claim 4 in which the controller comprises a PLC (Programmable logic control).

6. The method according to claim 4 in which the controller controls the hoist function directly by means of a PWM (Pulse Width Modulation) value.

7. The method according to claim 1 in which a hydraulic hoist is controlled indirectly by means of a pilot control valve.

8. The method of claim 7 in which the pilot control valve is connected to:

receive hoist pilot pressure from a joystick control in the mobile container handler; and control the supply of the hoist pilot pressure to a hoist valve.

9. The method according to claim 7 in which the pilot control valve comprises a pressure control valve.

10. The method according to claim 7 in which the pilot control valve comprises a flow control valve.

11. The method according to claim 7 in which the pilot control valve comprises a directional control valve and a pressure relief valve.

12. The method according to claim 1 performed using electric relays and timers.

13. The method according to claim 1 in which resuming further comprises resuming the normal mode of the hoist function of the mobile container handler when all of iii, iv, and the following condition are satisfied:

v=a prescribed non-zero amount of time has elapsed after condition iv has occurred.

14. The method of claim 13 in which the prescribed non-zero amount of time comprises two or more seconds.

15. The method according to claim 1 in which the spreader comprises twistlocks for locking the shipping container.

16. The method of claim 15 in which monitoring whether the spreader is locked is performed using signals from position sensors for the twistlocks.

17. The method according to claim 1 in which monitoring whether the spreader is landed is performed using signals from landed pin position sensors on the spreader.

18. The method according to claim 1 in which limiting the hoist function comprises reducing the maximum power of the hoist function to 25% or less relative to the maximum power of the hoist function when in the normal mode.

19. The method according to claim 1 further comprising retrofitting the mobile container handler with a controller programmed to carry out the method.

20. The method according to claim 1 in which the mobile container handler comprises a reach stacker or a top pick.

21. A mobile container handler comprising:

a spreader mounted on an extendable boom or a mast and carriage assembly;

the mobile container handler configured to perform a method of operating the mobile container handler, the method comprising:

a. monitoring whether the spreader is locked to a shipping container;

b. monitoring whether the spreader is landed on the shipping container;

c. limiting a hoist function of the mobile container handler when both of the following conditions are satisfied:

i=the spreader is locked to the shipping container; and ii=the spreader is landed on the shipping container; and d. resuming a normal mode of the hoist function of the mobile container handler when all of the following conditions are satisfied:

iii=the spreader is locked to the shipping container; and iv=the spreader is not landed on the shipping container.

22. A controller programmed to carry out, when installed on a mobile container hander, a method of operating the mobile container handler, which has a spreader mounted on an extendable boom or a mast and carriage assembly, the method comprising:

a. monitoring whether the spreader is locked to a shipping container;

b. monitoring whether the spreader is landed on the shipping container;

c. limiting a hoist function of the mobile container handler when both of the following conditions are satisfied:

i=the spreader is locked to the shipping container; and ii=the spreader is landed on the shipping container; and d. resuming a normal mode of the hoist function of the mobile container handler when all of the following conditions are satisfied:

iii=the spreader is locked to the shipping container; and iv=the spreader is not landed on the shipping container.

* * * * *